US005207363A

United States Patent [19]

Duchi, Jr. et al.

[11] Patent Number: 5,207,363

[45] Date of Patent: * May 4, 1993

[54] LANYARD

[75] Inventors: Anthony L. Duchi, Jr., Fallbrock; Fred R. McAlister, Sr., Chino, both of Calif.

[73] Assignee: MAG Instrument, Inc., Ontario, Calif.

[ * ] Notice: The portion of the term of this patent subsequent to Oct. 1, 2008 has been disclaimed.

[21] Appl. No.: 742,050

[22] Filed: Aug. 8, 1991

Related U.S. Application Data

[60] Division of Ser. No. 436,899, Nov. 15, 1989, Pat. No. 5,052,602, which is a continuation of Ser. No. 188,369, Apr. 29, 1988, abandoned.

[51] Int. Cl.[5] ..... A45F 5/00

[52] U.S. Cl. ..... 224/255; 87/13

[58] Field of Search ..... 224/172, 217, 218, 222, 224/253, 255, 267; 24/3 K, 3 M, 115 A, 129 W, 301, 302; 362/187, 202, 208; 57/202; 87/13

[56] References Cited

U.S. PATENT DOCUMENTS

| | | | |
|---|---|---|---|
| 196,588 | 10/1877 | Leonard | 24/265 A |
| 1,327,534 | 1/1920 | Eichstedt | 24/3 K |
| 1,405,052 | 1/1922 | Maher | 294/74 |
| 1,689,251 | 10/1928 | Ogush | 224/172 X |
| 2,643,638 | 6/1953 | Villmer | 294/74 X |
| 2,728,501 | 12/1955 | Hill | 224/219 |
| 2,794,582 | 6/1957 | Baldridge | 224/103 |
| 2,835,945 | 5/1958 | Hilsinger | 24/3 C |
| 2,879,990 | 3/1959 | Eaton | 24/302 X |
| 3,067,570 | 12/1962 | Nischan | 57/202 |
| 3,310,333 | 3/1967 | Hutson | 294/74 X |
| 3,367,102 | 2/1968 | Meger | 57/202 |
| 3,583,749 | 6/1971 | Hopkins | 294/74 |
| 3,751,769 | 8/1973 | Reiner | 24/300 |
| 3,827,790 | 8/1974 | Wenzel | 24/3 C |
| 3,891,174 | 6/1975 | Harvey | 24/301 X |
| 4,036,101 | 7/1977 | Burnett | 294/74 X |
| 4,159,792 | 7/1979 | Siegal | 24/3 M |
| 4,203,150 | 5/1980 | Shamlian | 362/202 X |
| 4,317,257 | 3/1982 | Engel | 294/74 |
| 4,656,565 | 4/1987 | Meglica | 362/187 |
| 5,052,602 | 10/1991 | Duchi et al. | 224/218 |

FOREIGN PATENT DOCUMENTS

| | | | |
|---|---|---|---|
| 699325 | 2/1931 | France | 24/115 H |
| 689012 | 4/1965 | Italy | 24/3 K |

*Primary Examiner*—Henry J. Recla
*Assistant Examiner*—Robert M. Fetsuga
*Attorney, Agent, or Firm*—Lyon & Lyon

[57] ABSTRACT

A lanyard made of a weavable, braided material having a loop at one end fashioned by turning the end of the lanyard braid back upon itself and a second end of the lanyard having a loop fashioned by turning the end of the lanyard back onto itself and inserting the end into the braid of the lanyard and fastening both with a common metal ferrule and further containing a metal ring held within each end loop.

5 Claims, 2 Drawing Sheets

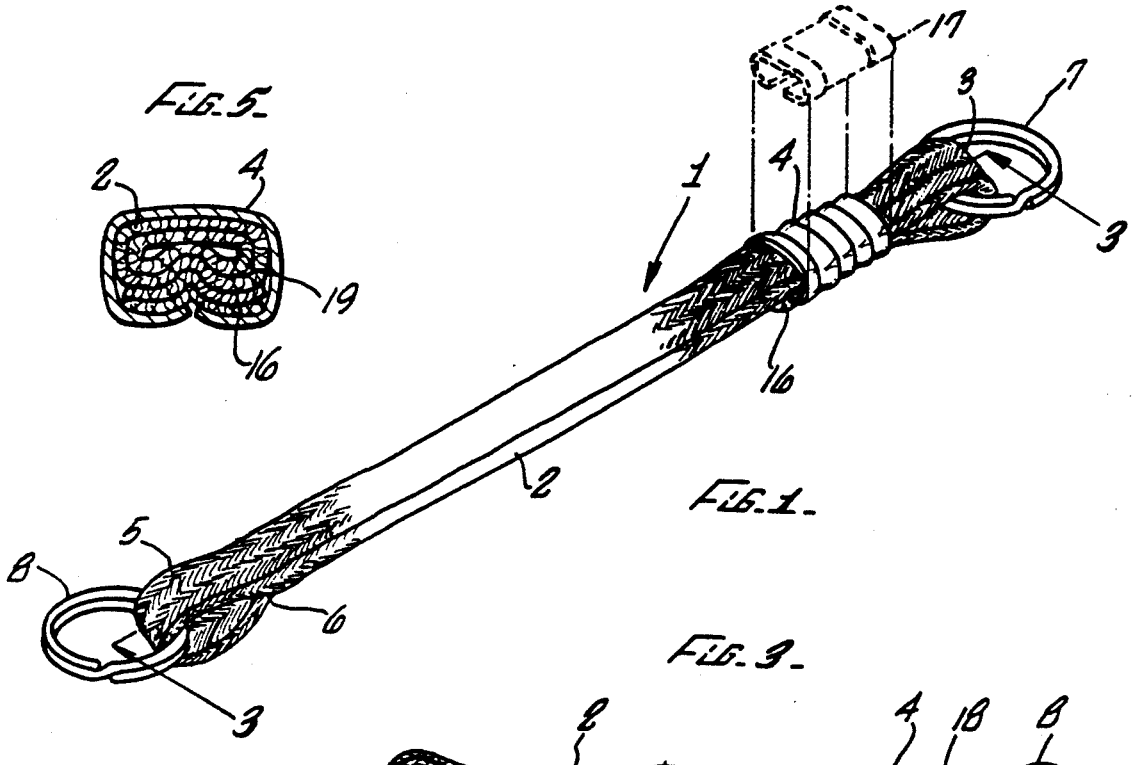
FIG. 1.
FIG. 5.
FIG. 3.
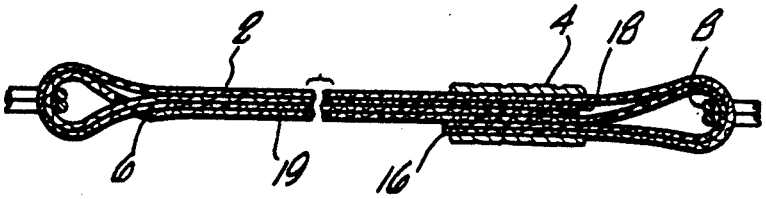
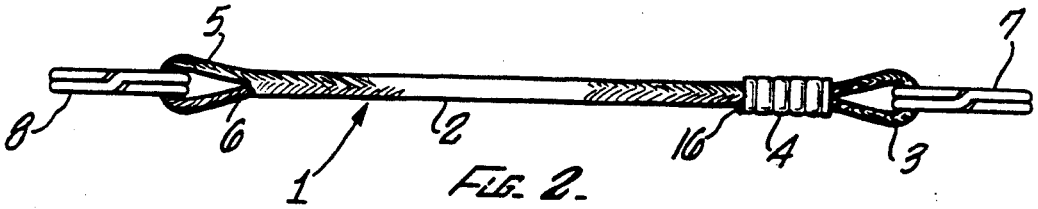
FIG. 2.
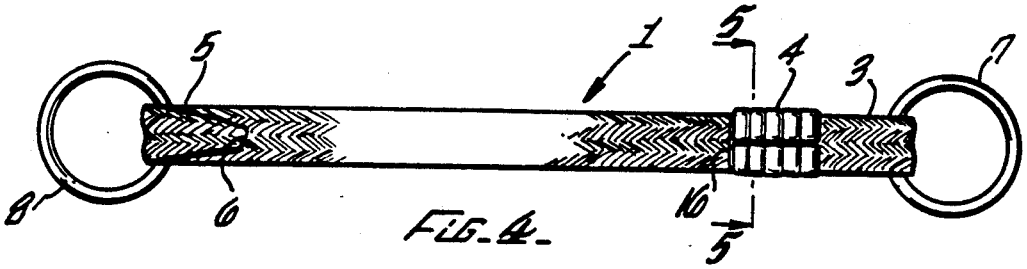
FIG. 4.
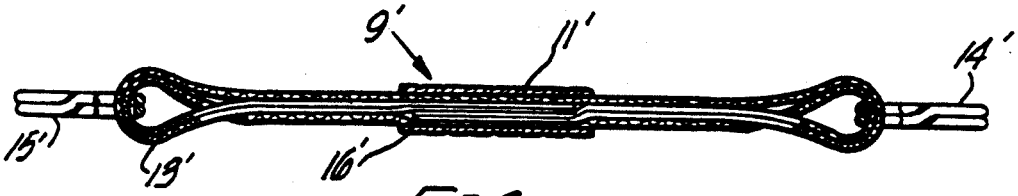
FIG. 6.

LANYARD

This is a divisional of U.S. application Ser. No. 436,899, filed Nov. 15, 1989, U.S. Pat. No. 5,052,602, which is a continuation of U.S. application Ser. No. 188,369, filed Apr. 29, 1988, now abandoned, both of which are incorporated herein by reference.

BACKGROUND

This invention relates to an improved lanyard. Lanyards of various lengths and configurations are known; however, known lanyards typically employ a ferrule or sleeve clamped to form and maintain a loop at each end thereof. These ferrules or sleeves are relatively expensive to manufacture, especially ferrules specially made to custom order and having a cosmetic appearance. Also, when one of these ferrules is positioned on a lanyard at the end adjacent to a polished article such as a flashlight, it is relatively highly likely to mar the polished surfaces of the flashlight or article.

OBJECTS OF THE INVENTION

It is the primary object of the present invention to provide a lanyard which has closed loops as both ends thereof, is economical to manufacture and which eliminates the need for a ferrule at each end of the lanyard and to reduce the likelihood of maring a polished or high luster surface of an object to which the lanyard is secured.

It is another object of the present invention to provide a lanyard having at least one of its end loops formed and relatively permanently maintained by inserting the lanyard material back into itself after having formed a loop.

These and other objects of the present invention will become apparent from the following description taken in conjunction with the accompanying drawings.

SUMMARY OF THE INVENTION

By the following description an improved lanyard is described which accomplishes the aforementioned objects and which provides for a lower cost, improved lanyard for use with small hand tools, articles, and the like, especially miniature, hand-held flashlights.

The lanyard of the present invention comprises a length of material, preferably of a weavable, flexible, durable material woven into a braid and having at one end a loop formed either by the material having been formed into a loop with its end inserted back into the inside of the braid, to form a permanent loop or by the material forming loops at both ends with a single ferrule or sleeve in the center, either of which may incorporate a ring, rings, and/or alternate retaining or decorative hardware.

BRIEF DESCRIPTION OF THE DRAWINGS

FIG. 1 is a perspective view of a preferred embodiment of the lanyard of the present invention.

FIG. 2 is a side view of the FIG. 1 lanyard.

FIG. 3 is a cross-section view of FIG. 1 taken along line 3—3.

FIG. 4 is a bottom view of the FIG. 1 lanyard.

FIG. 5 is a cross-section view of FIG. 4 taken along line 5—5.

FIG. 6 is a side, cross-sectional view of a lanyard having a single ferrule forming both end loops.

DETAILED DESCRIPTION OF THE PREFERRED EMBODIMENT

Figure 7:
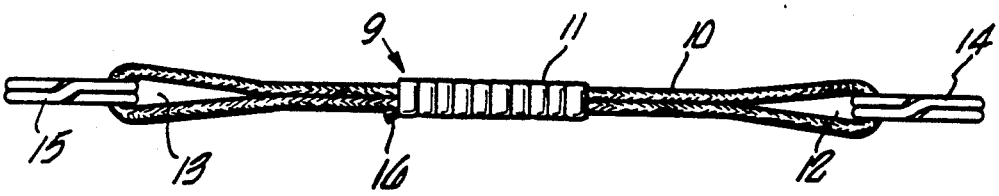
FIG. 7 is a side view of an alternate embodiment of a lanyard having a single ferrule forming both end loops.

By reference to FIGS. 1–5 the preferred embodiment of the present invention will be described. The lanyard 1 comprises a woven, hollow braid 2 having at its either closed end loops 3 and 5 through which rings 7 and 8 are incorporated. The braid 2 may be made of any suitable material which can be woven, such as cloth, leather, or plastic. Preferably, however the braid material is a supple, durable, weavable, multi-strand, braided nylon.

One end of the lanyard loop 3 is formed by one end 16 of the braid 2 being turned back upon itself and being fastened with a ferrule or sleeve 4 swaged to secure the end 16 as shown in detail in FIG. 3. The ferrule 4 may be made of any suitable material such as metal, plastic, wood, etc., but preferably is made of a ferrous or non-ferrous metal such as stainless steel, bright chrome or nickel plated ferrous or non-ferrous metal. The ferrule may be of any desired appearance, such as ferrule 4 shown in solid lines in FIG. 1 or, for example alternate ferrule 17, shown in phantom lines in FIG. 1. The loop 3 is formed with ring 7 which is preferably of the same material as the ferrule 4 and is of an offset, tapered, flush end configuration as shown in FIGS. 1–2.

The second end of the lanyard braid 2 is fashioned into a loop 5 by turning the end of the braid back into itself and inserting the end back into the main body cavity of the braid 2 through a slit 6 in one side of the braid so as to create a loop of substantially the same dimensions as loop 3 on the opposite end of braid 2. The re-inserted loose end 18 of the braid passes through the center of the braid 2 and through the non-loop length of the braid 2 where it dead-ends at least about 90% into the ferrule 4, as shown in FIG. 3. The inserted braid is shown as 19 in FIGS. 3 and 5. The ferrule 4 is then swaged into place and functions to capture and secure both ends 16, 18 of the braid 2, with end 16 extending beyond the ferrule and end 18 entirely captured within ferrule 4.

The loop 5 also has a second ring 8 which, preferably, is identical in size to the ring 7. The rings 7 and 8 may be of different sizes and may be of different materials, as desired.

As shown in FIGS. 1–5 one end of the cord 2 has a loop 3 fashioned with a ferrule securing the external and internal braid loose ends and the second end has a loop fashioned of a single looped braid.

Figure 8:
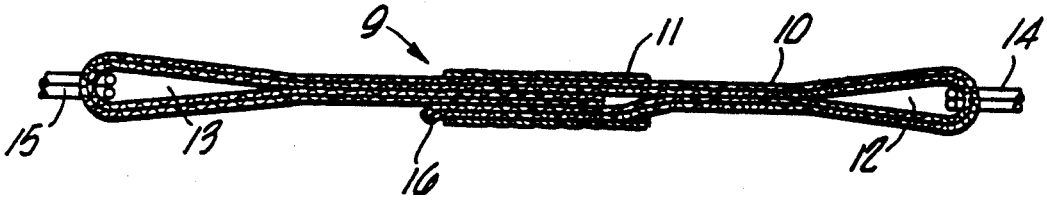
FIG. 8 is a side cross-sectional view of the FIG. 7 drawing.

Referring to FIG. 7 and FIG. 8 a lanyard 9 having a double loop formed by a single ferrule is shown. Cord 10 is preferably of the same material as is the braid 2 of the FIG. 1 lanyard and is of slightly longer length than braid 2, although it may be of non-braided material. Single ferrule 11, shown in the center, forms loop 12 and loop 13 at opposite ends of the ferrule 11. Ferrule 11 is preferably made of the same material as ferrule 4 and is also swaged to fasten the ends of the cord 10 as with respect to the ferrule of the FIG. 1 lanyard. At either end rings 14 and 15 are provided as previously described with regard to rings 7 and 8 of the FIG. 1 lanyard. In this embodiment, both loops 12 and 13 are remote from the ferrule 11 to reduce the likelihood of maring a polished or high luster surface.

Figure 9:
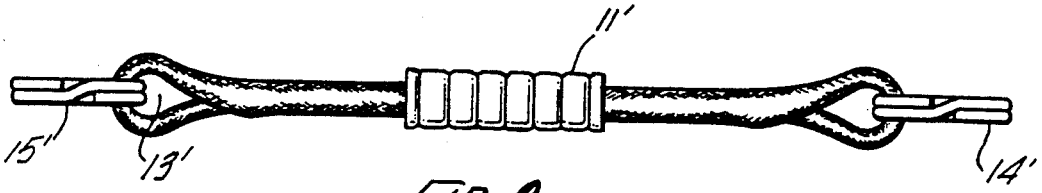
FIG. 9 is a side view of the FIG. 6 drawing.
Figure 10:
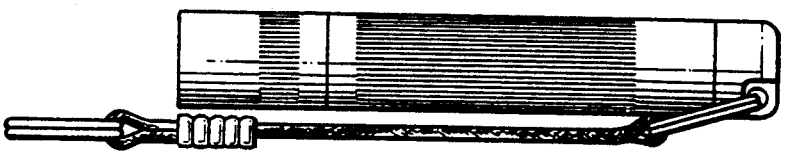

Referring to FIGS. 6 and 9, an alternate embodiment of the lanyard is shown having both ends of the braid forming loops by turning each end of the braid back into itself to form the loops and wherein the first end and second end are secured by a ferrule. Similar reference numerals are used in FIGS. 6 and 9 to refer to similar parts in FIGS. 7 and 8 except that the FIGS. 6 and 9 reference numerals use a "'" designation.

The lanyard of the present invention may be employed in any use that conventional lanyards are used, but preferably are for use with miniature flashlights, small hand-held tools, articles, cosmetic cases or other high luster finished items that are subject to surface marring by metallic objects such as ferrules. When used With miniature flashlights, the lanyard of the present invention also provides a means for attachment of a key ring or keys to the flashlight and for simultaneous illumination of a lock and its key while being held in one hand. When the loop 5 end of the preferred lanyard or either end of the FIG. 6 lanyard is attached to the key ring of a polished article, such as a flashlight, there is reduced likelihood that its surface will be marred because that end of the lanyard does not have a ferrule.

While the preferred embodiments of the herein invention have been described, numerous modifications, alterations, alternate embodiments and alternate materials may be contemplated by those skilled in the art and may be utilized in accomplishing the objects of the present invention, it is envisioned that all such alternates are considered to be within the scope of the present invention as defined by the appended claims.

We claim:

1. A key ring comprising a lanyard including a hollow cord of predetermined length, a sleeve tightly positioned about said cord, a first loop at a first end of said cord defined by said cord turned back upon itself and secured with said sleeve and a second loop at a second end of said cord being defined by said cord having been turned back upon itself and inserted into said cord;

a first ring through said first loop;

a second ring through said second loop;

a miniature flashlight, one of said first and second rings being coupled to said flashlight, said predetermined length being sufficient to allow illumination by said flashlight of the other ring of said first and second rings.

2. The key ring of claim 1 wherein said cord is braid.

3. The key ring of claim 1 wherein said cord is nonmetallic.

4. A key ring comprising a lanyard including a braid of predetermined length, a sleeve tightly positioned about said braid, a first loop at a first end of said braid defined by said braid turned back upon itself and secured with said sleeve and a second loop at a second end of said braid being defined by said braid having been turned back upon itself and inserted into said braid wherein the second end of said braid terminates within said sleeve;

a first ring through said first loop;

a second ring through said second loop;

a miniature flashlight, one of said first and second rings being coupled to said flashlight, said predetermined length being sufficient to allow illumination by said flashlight of the other ring of said first and second rings.

5. A key ring comprising a lanyard including a hollow cord of predetermined length, a sleeve tightly positioned about said cord, a first loop at a first end of said cord defined by said cord turned back upon itself and inserted into the interior of said cord, a second loop at a second end of said cord being defined by said cord having been turned back upon itself and inserted into the interior of said cord wherein said first end and said second end are secured by said sleeve clamped around said cord in overlapping relation to said first and second ends;

a first ring through said first loop;

a second ring through said second loop;

a miniature flashlight, one of said first and second rings being coupled to said flashlight, said predetermined length being sufficient to allow illumination by said flashlight of the other ring of said first and second rings.

* * * * *